US007500576B1

(12) United States Patent
Alvarez

(10) Patent No.: US 7,500,576 B1
(45) Date of Patent: Mar. 10, 2009

(54) DENTAL TRAINING CUP APPARATUS AND METHODS FOR USE

(76) Inventor: José Luis Alvarez, 6749 Isla Del Rey, El Paso, TX (US) 79912

( * ) Notice: Subject to any disclaimer, the term of this patent is extended or adjusted under 35 U.S.C. 154(b) by 854 days.

(21) Appl. No.: 10/940,569

(22) Filed: Sep. 14, 2004

(51) Int. Cl.
*A47G 19/22* (2006.01)
*A46B 9/04* (2006.01)

(52) U.S. Cl. ..... 220/212; 220/717; 15/167.2; 606/235

(58) Field of Classification Search ..... 220/212, 220/717; 15/167.2; 606/235
See application file for complete search history.

(56) References Cited

U.S. PATENT DOCUMENTS

| | | | | |
|---|---|---|---|---|
| 4,115,893 | A * | 9/1978 | Nakata et al. | 15/110 |
| D313,317 | S | 1/1991 | Brunner et al. | D4/103 |
| 5,009,881 | A | 4/1991 | Hill et al. | 424/49 |
| 5,234,117 | A * | 8/1993 | Garvin | 215/11.4 |
| 5,542,670 | A | 8/1996 | Morano | 220/714 |
| 5,890,620 | A | 4/1999 | Belcastro | 220/714 |
| 6,050,445 | A | 4/2000 | Manganiello | 220/714 |
| 6,102,245 | A | 8/2000 | Haberman | 220/714 |
| RE37,016 | E | 1/2001 | Morano | 220/714 |
| 6,196,413 | B1 * | 3/2001 | Tung | 220/709 |
| 6,230,923 | B1 * | 5/2001 | Hung | 220/703 |
| 6,241,110 | B1 * | 6/2001 | Hakim | 215/11.1 |
| 6,422,415 | B1 | 7/2002 | Manganiello | 220/714 |
| 6,705,485 | B1 | 3/2004 | Sato et al. | 220/713 |
| 6,865,767 | B1 * | 3/2005 | Gavney, Jr. | 15/114 |

OTHER PUBLICATIONS

Making Baby's Firth Brushing Experience, Baby's Best from www.marketlaunchers.com, Aug. 18, 2004.
From Daily Living, children's toothbrush ads from www.theraproducts.com, Aug. 25, 2004.
From Google search, , four pages on Infa-dent finger toothbrush, done Sep. 13, 2004.

* cited by examiner

*Primary Examiner*—Anthony D Stashick
*Assistant Examiner*—James N Smalley
(74) *Attorney, Agent, or Firm*—Lori M. Friedman

(57) ABSTRACT

The invention discloses a cup apparatus that comprises a child's training cup that is modified to clean a child's baby teeth and gums with comfortable, cleaning elements are perpendicular to each other. To use the device and methods of this invention for cleaning the upper four front baby teeth, the child's lips surround the mouthpiece holes so that when he sips liquid from the cup apparatus, his four front teeth come in contact with the tooth cleaning members. The device is designed for children from about 6 months to about three years old. It removes plaque-like and decay-producing substances decay painlessly and effortlessly as well as reducing parental involvement in the child dental health.

20 Claims, 4 Drawing Sheets

DENTAL TRAINING CUP APPARATUS AND METHODS FOR USE

FIELD OF THE INVENTION

This invention relates to a cup apparatus for use by a child of from about 6 months to about three years of age. More specifically, the invention discloses a lid for a plastic cup into which has tooth cleaning members permanently attached to it that clean a child's teeth while he sips liquid from the mouthpiece of the cup's lid. The invention also discloses methods for use of the cup apparatus including the child's independent use of the cup whereby the teeth and gums are cleaned effortlessly while the child sips liquid. In this manner, the child's oral hygiene habits are not dependent on parental involvement.

BACKGROUND AND RELATED ART

Use of special cups for children designed to train them to drink from the cup instead of a baby bottle are in common use in today's marketplace. They are often called "sippy" cups and there are many varieties available. The cups, typified by those disclosed in US patents such as U.S. Pat. No. 5,890,620 to Belcastro, U.S. Pat. No. 6,102,245 to Haberman, and U.S. Pat. No. 6,705,485 to Sato et al each describe sipping cups and lids for use by babies and children. None of these patents disclose anything about oral hygiene. The use of sippy cups is in fact somewhat controversial because those that are spill-proof can lead to the habit of the child's sucking the cup's mouthpiece while lying down, as if it were a baby bottle.

Playtex Products, Inc. is the assignee of at least four US patents on their product, the "Sipster™" cup. They are U.S. Pat. Nos. 5,542,670, 6,050,445, 6,422,415, and RE37,016. The cups disclosed in these patents are concerned with fluid flow throw the cup, spill-proof qualities. Oral hygiene is nowhere mentioned in any of the above-cited Playtex patents.

Oral hygiene for small children and edentulous people is mentioned in U.S. Pat. No. 5,009,881. In 881 Hill et al mention oral hygiene gels and discuss the application of said gels to the irritated gums Application of the gel, as seen in column 7 of '881 is by the use of "a finger, a gauze-wrapped finger, or a soft bristled brush". Although oral hygiene is mentioned, there is nothing similar to the cup apparatus of the present invention in '881.

A combined finger toothbrush and gum massager as described in US Design patent DES 313,317 to Brummer et al and a baby bottle toothbrush, as advertised on-line at market-launchers.com are products that are concerned with the cleaning the teeth of small children. The cleaning members of these devices are meant to be used on a fingertip of an adult and could not be used by a child himself. This device does not in any way introduce the child to clean his teeth.

Applicant, who is a dentist, is experienced in caring for children's teeth and has devised the toothbrush training cup apparatus of this invention to solve the problem of childhood tooth decay. By using the cup apparatus of this invention to sip a fluid, a child will simultaneously clean his teeth. The cup apparatus of this invention has no valves to control fluid flow and is not drip-proof. This prevents the child from using the cup when he is a reclining position, and therefore become dependent on the cup as one would a baby bottle.

BACKGROUND DISCUSSION

A child's first teeth, which are deciduous and often called "baby teeth" are important to both the child's health and to his future permanent teeth. As a baby or young child, tooth decay can cause inability to chew food, to speak properly, and have an attractive smile. Deciduous teeth hold space in the jaw for the permanent teeth, as well. If a deciduous tooth is lost prematurely, neighboring teeth can drift into the empty space. This can cause crooked and crowded permanent teeth, requiring orthodontics and other adult tooth problems.

Prevention of childhood tooth decay is one of the objects of the present invention. The apparatus and methods described herein apply to children from about 6 months to about 3 years of age. It is related to another malady called "baby bottle tooth decay". The most common area for decay are the upper four front teeth. Baby bottle tooth decay occurs when a baby lies down with a bottle that is filled with a liquid such as milk, formula, fruit juice, or a sweet liquid like soda pop or a sugary drink. When these liquids stay on the teeth for extended periods of time, the sugar and bacteria contained therein starts to decay the teeth. Warnings about baby bottle tooth decay extend to small children using spill-proof training ("sippy") cups. Many childhood experts, including the American Dental Association state that children should start drinking from a cup from the age of about one year, and advise not using training cups because of the possible prolonged contact of deciduous teeth with sugary liquids, as has just been described.

SUMMARY OF THE INVENTION

In response to the above mentioned need for improved cleaning of a child's deciduous teeth, applicant has devised a cup apparatus to be used for children from about 6 months to about 3 years of age. This apparatus comprises a small plastic cup, attached to which is a removable threaded lid which unscrews for filling and cleaning. Permanently attached to the lid is a mouthpiece from which the child will sip liquid. An optional attachment to the underside of the cup lid is a removable plastic straw, which attaches to the indentation that is there for the mouthpiece.

There is a groove is between the top, flat part of the lid and the mouthpiece holes which holds two layers of tooth cleansing members. These cleaning elements are perpendicular to each other and comprise soft gel-like bristles that clean the child's teeth without trauma to surrounding gingiva.

There is a flat area of about five mm anterior to the tooth cleaning members on the mouthpiece where that allows suction to occur when the child's lips are placed on either side of the mouthpiece. These tooth cleaning members are each about 4 mm by 20 mm in area which equal the approximate size of the child's deciduous front four teeth.

The invention also comprises methods of use of the cup apparatus. These methods teach both adult and child to use the cup apparatus to painlessly and effortlessly clean a child's upper four front teeth while he is sipping liquid from the cup apparatus of this invention. The aim of these methods is to improve the oral health of a child by using the cup apparatus. This is so that cleaning the child's teeth is done largely by the child himself without intervention by an adult after an initial learning experience. Since the only holes of the assembled cup apparatus are in the mouthpiece, there is no valve cover to prevent spillage so that the child will only use the cup while he is sitting or standing and will not get into a habit of lying down or sleeping with the cup. To drink from the assembled cup apparatus, the child sips liquid through the mouthpiece while holding the cup at AN angle sufficient for the liquid to flow. If the optional straw is used, the cup could be held upright and not tilted at all.

DETAILED DESCRIPTION OF PREFERRED EMBODIMENTS

A child's deciduous teeth (baby teeth) are important because children need strong, healthy teeth to chew food, speak properly, and have an attractive appearance. The child's first set of teeth are also important reserving space for his permanent teeth. If a baby tooth is lost prematurely, the other teeth may shift into its empty space. When the permanent teeth appear, the shifted baby teeth may cause them to grow crookedly and/or crowded. The invention provides the ways and means to prevent these and other childhood dental problems.

Figure 1:
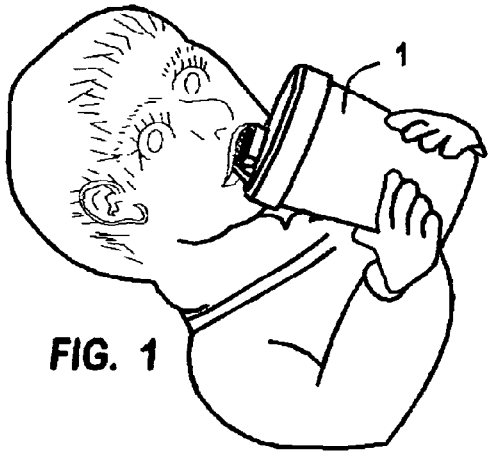
FIG. 1 depicts a child using the cup apparatus of this invention.
Figure 2:
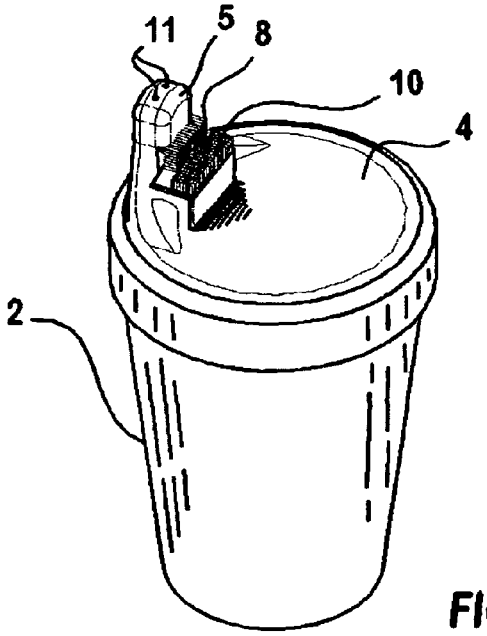
FIG. 2 shows an overview of the cup apparatus of this invention.
Figure 3:
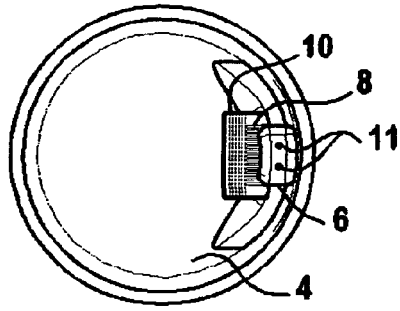
FIG. 3 is a top view of the lid of the cup apparatus.
Figure 4:
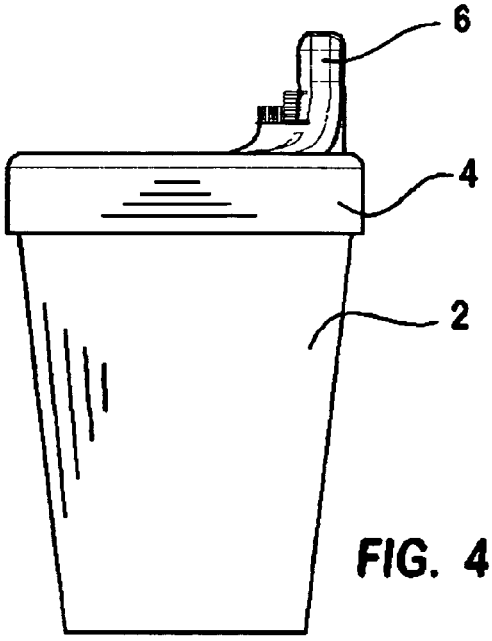
FIG. 4 is a side view of the cup apparatus.
Figure 5:
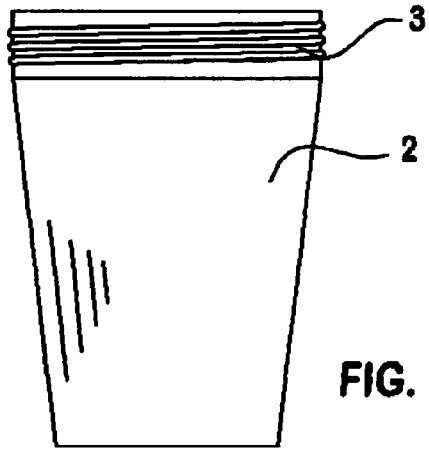
FIG. 5 is a side view of the cup of the apparatus.
Figure 6:
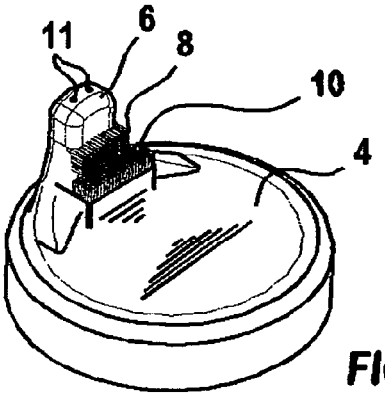
FIG. 6 is a detailed overview of the lid of the cup apparatus.
Figure 7:
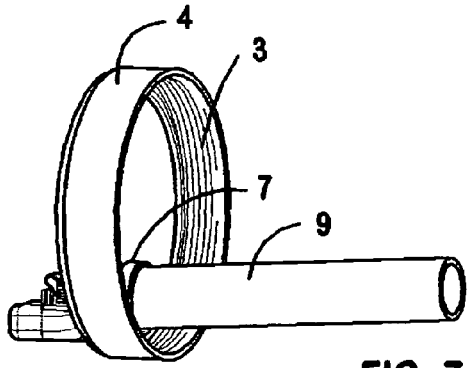
FIG. 7 is view from the underside of the lid, with an optional plastic cover piece with straw for improved drinking capability of the cup apparatus.

With reference now to the figures, FIG. 1 shows a child sipping from the cup apparatus 1 of the current invention. The child using the cup can be either male or female; please note that in this disclosure the pronoun "he" will be used when referring to the child. The details of the cup apparatus 1 are shown in the later figures including FIG. 2, which shows the cup apparatus 1 of the invention. The cup apparatus 1 comprises a plastic cup 2, which holds a quantity of liquid ranging from about 5 to about 10 ounces. The cup 2, as shown in FIG. 5, is threaded with grooves. The lid 4 is fitted with threads that match the threads 3 of the cup 2. The cup 2 is filled with from about five to about 10 ounces of a drinkable liquid (not shown). In the interest of the child's dental health, the liquid should not be sugared.

The cup apparatus 1 is made from a standard plastic training cup that is widely sold for use by children. These training cups are used as replacements for baby bottles for children ranging in age from about 6 months to about three years. The child's first teeth 16*d-g*, as pictured in FIG. 10 will usually appear between these ages. A preferred training cup that was used to construct the cup apparatus 1 of this invention is the Playtex® Sipster™ cup. This cup is available for purchase at a wide variety of merchandisers.

The American Dental Association strongly recommends that a baby's teeth be cleaned as soon as they appear, for reasons that have already been stated. As has been mentioned previously, inventions for early cleaning of these teeth are available. A typical product is the Infa-Dent® soft finger toothbrush. This device is meant to be used on a fingertip of an adult to clean a baby's gums and emerging teeth. The Infa-Dent device is meant to be used by an adult, and there is nothing about the product that suggests its use by a child himself. This, in fact, would not be possible.

Applicant understands the importance of dental care for young children and wanted to design a product that would allow and encourage a young child to administer his own dental hygiene, and not be dependent on parental involvement to clean his teeth. In fact, many parents unknowingly contribute to their child's tooth decay by giving them sugary drinks in training cups, both during the day and at bedtime. This is quite problematic, especially if the training cup is one of the no-spill variety. In that case, the child can fall asleep with the cup in his mouth, coating his teeth and gums with sugary liquid all night long.

As seen in FIGS. 1-11, this invention provides a cup apparatus 1 designed for use by a small child for sipping liquid through a mouthpiece 6. The cup apparatus 1 comprises a plastic cup 2 with a removable threaded lid 4. The cup 2 has a capacity of from about 5 to about 10 ounces of a drinkable liquid;

The threaded lid 4 covers the cup 2 and screws tightly onto the top of the cup 2. It has a mouthpiece 6 with at least two holes 11 at its top from which the child sips liquid. It has, optionally, a plastic straw 9 that extends from the bottom of the mouthpiece 11 opening to the bottom of the plastic cup 2. If a straw 9 is used, it will fit into a plastic disk 7 that covers the mouthpiece opening in the underside of the lid 4.

The mouthpiece 6 contains an L-shaped groove 18 which is located between the top, flat part of the lid 4 and the mouthpiece holes 11 which holds two separate layers of tooth cleansing members 8 and 10 whose cleaning elements are perpendicular to each other.

The cleaning members 8 and 10 contact the child's upper four front teeth, 16*d-g* and surrounding gingiva when the child sips from the cup apparatus 1 and simultaneously cleans his teeth painlessly and effortlessly while drinking liquid.

Figure 11:
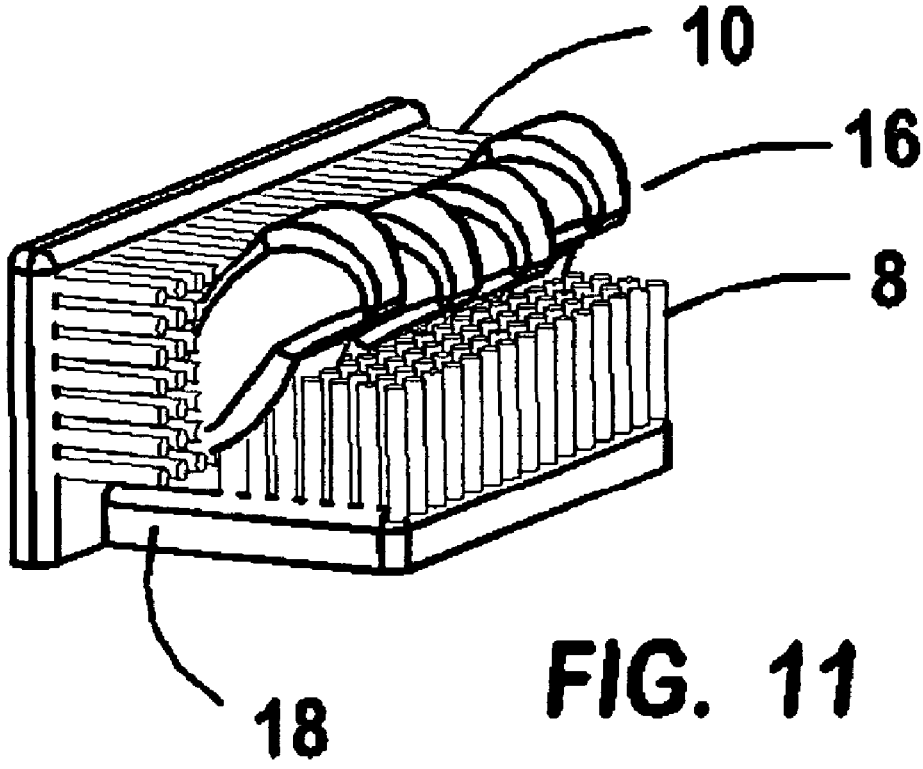
FIG. 11 is a depiction of the four front deciduous teeth in contact with the tooth cleaning members of the cup apparatus

The mouthpiece 11 has been designed so that the child obtains maximum tooth 16 coverage by the tooth cleansing members 8 and 10 as he sips liquid from the cup apparatus 1. The tooth cleansing members 8 and 10 are permanently affixed in a plastic groove 18 that is about 20 mm in width 19 and about 4 mm in height. Into the groove 18 is the lower cleansing member 10 and the upper cleaning member 8. The two tooth cleansing members 8 and 10 meet and as seen in FIG. 11, effortlessly and painlessly clean the child's teeth as he sips liquid from the cup apparatus 1.

Figure 8:
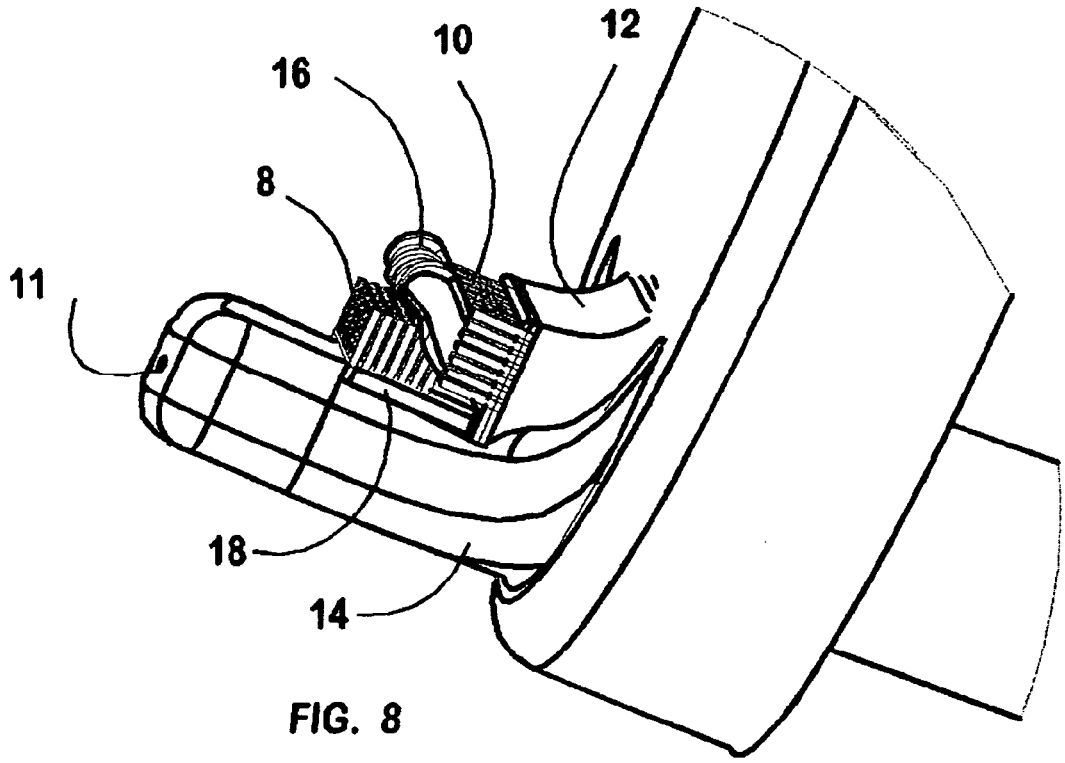
FIG. 8 shows teeth as they are cleaned by using the curved mouthpiece of the cup apparatus.
Figure 9:
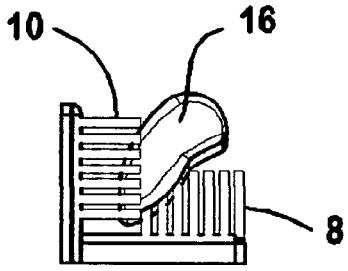
FIG. 9 details a tooth in contact with the tooth cleaning members of this invention.
Figure 10:
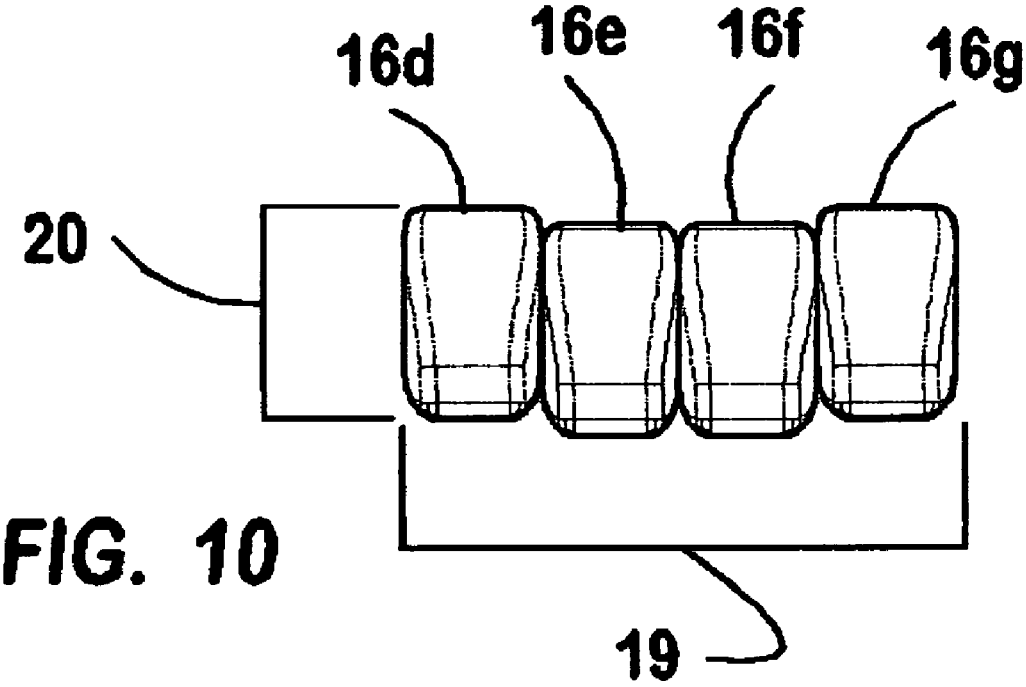
FIG. 10 depicts the four front deciduous teeth of a child.

The configuration of tooth cleansing members 8 and 10 are designed to come in contact with the four upper front deciduous teeth d, e, f, and g, labeled 16*d*, 16*e*, 16*f*, and 16*g* as shown in FIG. 10. The design of the tooth cleansing members 8 and 10 affixed as shown in FIGS. 8, 9, and 11 in the groove 18 provide coverage of both the facial surfaces and incisal surfaces of the four front teeth. It is known in dentistry that these are the teeth in which decay most frequently occurs in young children.

When constructing the dental training cup that constitutes this invention, applicant experimented with a variety of toothbrushes to obtain the maximum tooth coverage and comfort for the child using the training cup. When the bristles of a standard small, soft toothbrush were tried, they proved to be traumatic to gingival tissue. A successful candidate was found by cutting and using pieces of the softer, less abrasive Infa-Dent finger tooth tool.

Use of the Invention:

To drink from the assembled cup apparatus 1, the child sips liquid through the mouthpiece 11 while holding the cup apparatus 1 at angle sufficient for the liquid to flow. If the optional straw 9 (and the cover of the mouthpiece opening 7) is used, the cup could be held upright while drinking and not tilted at all. The degree to which the cup apparatus 1 must be tilted, if no straw 9 is used, depends upon how much liquid is in the plastic cup 2. It should be remembered that there are no valves or other spill-proof devices present in the cup apparatus 1 of the present invention. If the cup apparatus 1 containing liquid is turned upside down, the liquid will spill out. In all cases, when the child sips liquid from the cup apparatus 1 of this invention, his teeth are being cleaned by cleaning members 8 and 10 while his upper lip is in the space 12 and his lower lip is in space 14.

EXAMPLE

To determine if the cup apparatus 1 of this invention would work successfully, applicant performed the following experiment:

The parents of a 2-year old dental patient were instructed not to brush his teeth and to bring him into his dental office. When in the office, the child's teeth were coated with GUM Red-Coat plaque indicating dye. The dye covered all of the child's facial surfaces of all anterior teeth. The child was then given the cup apparatus 1 of this invention which was filled with water and told to sip for about two minutes. After the sipping was finished, his teeth were examined by applicant to see how much of the GUM Red-Coat plaque indicating dye was removed. About 40%-50% of the dye was removed by the child simply sipping water from the cup apparatus 1 of this invention.

Methods:

The cup apparatus 1 of this invention can be used by an adult who wants to teach his child to drink from the cup as a training cup weaning from baby bottle use. By using the cup apparatus 1 of this invention, the child is also cleaning his teeth.

In this manner, the parent or other adult caregiver can painlessly and effortlessly cleaning a child's teeth. To do so, an adult fills the threaded plastic cup 2 with from about 5 to about 10 ounces of a drinkable liquid. He then covers the plastic cup 2 with a screw-on threaded lid 4 that securely fastens the lid 4 and the cup 2.

The adult then gives the filled and assembled cup apparatus 1 to a child to hold in his hands so that the child's lower lip is below the mouthpiece holes 11 in space 14 and his upper lip is above the mouthpiece holes 11 in space 12. In this way, the child's four upper front teeth will be in contact with cleaning members 8 and 10 while the child is sipping from the cup, thereby cleaning his four upper front teeth while drinking liquid from the cup apparatus 1.

While drinking from the cup apparatus 1, if no straw 9 is used, the child must hold the cup apparatus 1 at an angle sufficient for fluid flow. Since there are no spill guards on the cup apparatus 1 the adult should direct the child to tilt the cup to initiate and continue liquid flow. The adult should also be sure that the child does not sleep or lie down with the cup apparatus 1.

While using the cup apparatus 1 both the facial surfaces and the incisal surfaces of the child's upper four front teeth are cleaned simultaneously while he sips liquid from the mouthpiece 6. In this manner, plaque-like and decay-producing substances are removed from the tooth surfaces and gingiva thus disrupting the cycle of plaque and decay formation which might otherwise occur and damage the child's teeth.

After the adult is convinced that the child is ready for independent use of the cup apparatus 1, he can start use of the dental training cup by himself. To do this, the child fills the plastic cup 2 with from 5 to 12 ounces of a liquid and then covers the cup 2 with a screw-on lid 4 that securely fastens them together.

He then grasps the mouthpiece 6 and puts his lower lip below the mouthpiece holes 11 in space 14 and his upper lip above the mouthpiece holes 11 in space 12. If there is a straw 9 assembled in the cup apparatus 1, he can sip liquid while holding the cup apparatus 1 upright. If no straw 9 is used, he must hold the cup at an angle sufficient for the liquid to flow.

As the child drinks from the cup apparatus 1 for at least two minutes, the child will have independently removed a significant amount of mouth debris from his upper four front teeth and surrounding gingiva. Furthermore, the tooth cleaning operation is done effortlessly and painlessly. It is also important that the tooth cleaning is done largely by the child himself without intervention by an adult after an initial learning experience.

In this way, both the facial surfaces and the incisal surfaces of the child's upper four front teeth are cleaned simultaneously while he sips liquid from the mouthpiece holes 11. Plaque and decay-causing substances are removed from the teeth and gingiva thus disrupting the cycle of plaque and decay formation which might otherwise occur and damage the child's teeth. The child does not sleep or lie down with the cup apparatus 1 and will not become accustomed to sleeping it.

SCOPE OF THE INVENTION

The above presents a description of the best mode contemplated of carrying out the present invention, and of the manner and process of using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiments disclosed. On the contrary, the intention is to cover all modifications and alternate constructions coming within the spirit and scope of the invention as generally expressed by the following claims, which particularly point out and distinctly claim the subject matter of the invention:

What is claimed is:

1. A drinking apparatus for use by a small child for sipping liquid through a cup with a mouthpiece, said apparatus comprising a plastic cup with a capacity of about 5 to about 10 ounces that holds a drinkable liquid;

a threaded lid that covers the cup and screws tightly onto the top of the cup that has a mouthpiece with at least two holes at its top through which the child sips liquid and a plastic straw that extends from the bottom of the mouthpiece opening to the bottom of the plastic cup;

said mouthpiece has an L-shaped groove which is externally located between the top, flat part of the lid and the mouthpiece holes which holds two separate rows of tooth cleansing members whose cleaning elements are perpendicular to each other and are in the form of two rows of bristles which are each about 4 mm by 20 mm in area which equal the approximate size of the child's deciduous front four teeth;

said tooth cleansing members contact the child's upper four front teeth and surrounding gingiva when the child sips from the cup and simultaneously cleans his teeth painlessly and effortlessly while he sips liquid from the cup.

2. The drinking apparatus of claim 1 wherein the child who uses it is from about 6 months to about 3 years of age.

3. The drinking apparatus of claim 1 wherein the only openings after the lid is screwed onto the drinking apparatus, are the mouthpiece holes, and there are no valves to prevent spillage.

4. The drinking apparatus of claim 3 wherein the child sips liquid through the mouthpiece while holding the cup at an angle sufficient for the liquid to flow without spillage.

5. The drinking apparatus of claim 1 wherein the straw is fitted into a plastic disk that covers the mouthpiece opening in the underside of the lid.

6. The drinking apparatus of claim 1 wherein both the facial surfaces and the incisal surfaces of the child's upper front four teeth are cleaned simultaneously while he sips liquid from the mouthpiece.

7. The drinking apparatus of claim 1 wherein the L-shaped groove is located between the top of the lid and the mouthpiece holes and which holds two rows of tooth cleansing members whose cleaning elements are perpendicular to each other and which comprise soft gel-like bristles that clean the child's teeth without trauma to surrounding gingiva.

8. The drinking apparatus of claim 7 wherein the bristles of the tooth cleaning elements are permanently attached to the mouthpiece and which has a flat area of about five mm anterior to the tooth cleaning elements to allow suction to occur when the child sips liquid from the mouthpiece.

9. The drinking apparatus of claim 8 wherein the tooth cleaning elements are each about 4 mm by 20 mm in area which equal the approximate size of the child's front four deciduous teeth.

10. A method of painlessly and effortlessly cleaning a child's teeth while he is sipping liquid from a drinking apparatus including a threaded plastic cup with tooth cleaning members permanently attached to it, said method comprising the steps of an adult;

a) filling the threaded plastic cup with from about 5 to about 10 ounces of a drinkable liquid;

b) covering the plastic cup with a screw-on threaded lid that securely fastens the lid and the cup, a plastic straw that extends from the bottom of the mouthpiece opening to the bottom of the plastic cup, said lid also contains an L-shaped groove which is externally located between the top of the lid and the mouthpiece with at least two holes with a flat area of about five mm anterior to two perpendicular rows of tooth cleansing members that comprise soft gel-like bristles and which are each about 4 mm by 20 mm in area, which equals the approximate size of the child's deciduous front four teeth, on said mouthpiece, allowing suction to occur when the child's lips are placed on either side of the mouthpiece;

c) giving the filled cup device to a child to hold and sip from so that the child's lips surround the mouthpiece holes so that when he sips liquid his four front teeth come in contact with the tooth cleansing members;

d) insuring contact between the child's upper front teeth with said cleansing members while the child is sipping from the cup;

thereby cleaning the teeth while simultaneously sipping liquid from the cup.

11. The method of claim 10 wherein the-child is sipping liquid through the mouthpiece of the drinking apparatus while holding the drinking apparatus at angle sufficient for the liquid to flow.

12. The method of claim 10 wherein the child is not sleeping or lying down while sipping from the drinking apparatus.

13. The method of claim 10 wherein both the facial surfaces and the incisal surfaces of the child's upper four front teeth are cleaned simultaneously while he sips liquid from the mouthpiece of the drinking apparatus.

14. The method of claim 10 wherein plaque-like and decay-causing substances are removed from a child's teeth and gingival by the two perpendicular rows of tooth cleansing members on the mouthpiece of the drinking apparatus thus disrupting the cycle of plaque and decay formation which might otherwise occur and damage the child's teeth.

15. A method of cleaning a child's teeth by himself comprising using a) a drinking apparatus with a removable, screw-on lid that securely fastens to a plastic cup with a capacity of from about 5 to about 10 ounces;

b) said lid of the drinking apparatus also comprising a plastic straw that extends from the bottom of the mouthpiece opening to the bottom of the plastic cup, an L-shaped groove externally located between the lid and a plurality of mouthpiece holes which holds two rows of soft gel-like bristles that are perpendicular to each other that clean the child's teeth without trauma to surrounding gingiva said rows of bristles;

c) said two perpendicular rows of bristles on the mouthpiece allowing suction to occur when the child's lips are placed on either side of the mouthpiece;

d) allowing the bristles to act as tooth cleaning members, each row of bristles being in the size of about 4 mm by 20 mm in area which equal the approximate size of the child's deciduous front four teeth;

d) enabling the child to simultaneously and independently remove a significant amount of mouth debris from his four front baby teeth and surrounding gingiva while sipping from the cup.

16. The method of claim 15 wherein cleaning the child's teeth is done effortlessly and painlessly while the child is sipping from the cup.

17. The method of claim 15 wherein the child's teeth cleaning is done largely by the child himself.

18. The method of claim 15 wherein both the facial surfaces and the incisal surfaces of the child's upper four front teeth are cleaned simultaneously while he Is sipping liquid from the mouthpiece of the plastic cup.

19. The method of claim 15 wherein plaque-like and decay-producing substances are removed from the child's upper four front teeth and the gingiva while he is sipping from the plastic cup, thus disrupting the cycle of plaque and decay formation which might otherwise occur and damage his teeth.

20. The method of claim 15 wherein the child is not sleeping or lying down with the drinking apparatus and does not become accustomed to sleeping with the cup in his mouth.

* * * * *